United States Patent [19]

Ishizuka et al.

[11] Patent Number: 4,854,083

[45] Date of Patent: Aug. 8, 1989

[54] POLISHING MACHINE USING SUPER ABRASIVE GRAINS

[75] Inventors: Hiroshi Ishizuka, Tokyo; Toshio Togano, Hiratsuka, both of Japan

[73] Assignee: The Ishizuka Research Institute, Kanagawa, Japan

[21] Appl. No.: 172,465

[22] Filed: Mar. 24, 1988

[30] Foreign Application Priority Data

Apr. 20, 1987 [JP] Japan ..... 62-59725[U]

[51] Int. Cl.[4] ..... B24B 7/22

[52] U.S. Cl. ..... 51/131.4; 51/123 R

[58] Field of Search ..... 51/131.4, 216 T, 236, 51/237 R, 237 M, 119, 120, 129, 131.1, 123 R, 131.3, 134, 232

[56] References Cited

U.S. PATENT DOCUMENTS

| | | | |
|---|---|---|---|
| 94,310 | 8/1869 | Hagaman | 51/131.3 |
| 1,003,816 | 9/1911 | Scoville | 51/123 R |
| 2,407,206 | 9/1946 | Luboshes | 51/131.4 |
| 2,825,187 | 7/1955 | Lindquist | 51/131.4 |
| 2,830,412 | 4/1958 | Shurson | 51/129 |

OTHER PUBLICATIONS

Marks' Standard Handbook for Mechanical Engineers, Eighth Edition, pp. 6–139, Lewis, Kenneth, The Grinding Wheel, 1959, pp. 18 and 19.

*Primary Examiner*—Frederick R. Schmidt
*Assistant Examiner*—Robert A. Rose
*Attorney, Agent, or Firm*—Larson and Taylor

[57] ABSTRACT

A polishing machine comprising: a rotary abrasive tool having a circular working face which comprises a mass of super abrasive grains, the face driveable by a motor to rotate about an axis, several arbors which, each, have an inversed cup-shaped work holder, detachably mounted at a lower end thereof and a minor gear in an upper portion and which are supported by a stage in a position perpendicular to said working face, the work holders being arranged in such relation that the open end of each of the work holders is opposite, at least partly, to the working face, the minor gears being engaged slidably along- and with a major gear which in turn is driven by a second motor, each arbor being engaged with a pressing device capable of pressing the work to keep in good contact with the tool working face, and a framework on which the abrasive tool and motor, as well as the stage are mounted.

1 Claim, 2 Drawing Sheets

POLISHING MACHINE USING SUPER ABRASIVE GRAINS

The present invention relates to a polishing machine and, in particular, such machine with a rotary abrasive tool deposited with super hard abrasive such as diamond, cubic- and wurtzite type boron nitride especially adequate for finish machining of very hard work materials, such as diamond, cubic- and wurtzite type BN and various ceramics.

Recently, diamond and cBN or wBN compacts are of increasing importance as a tool tip in machining of hard to very hard machinable materials ranging from various cemented carbides and ceramics to FRP's as well as various kinds of steel and non-ferrous metallic materials. Such compacts, produced and recovered in the form of disc are cut into sectors, ground to produce a precise flat surface and, when necessary, further mirror finished.

The process, however, requires a lengthy treating time because of the exceptional high hardness of the work materials while there have been very few machines available, as far as we are aware, capable of doing the job efficiently.

Thus one of the principal objects of the invention is to provide a solution to the problem just mentioned above.

According to the invention there is provided a polishing machine comprising: a rotary abrasive tool having a circular working face which comprises a mass of super abrasive grains, said face drivable by a motor to rotate about an axis, several arbors which, each, have an inversed cup-shaped work holder, detachably mounted at a lower end thereof and a minor gear in an upper portion and which are supported by a stage in a position perpendicular to said working face, said work holders being arranged in such relation that the open end of each of said work holders is opposite, at least partly, to said working face, said minor gears being engaged slidably along- and with a major gear which in turn is driven by a second motor, said arbor being engaged with a pressing device capable of pressing the work to keep in good contact with the tool working face, and a framework on which said abrasive tool and motor, as well as the stage are mounted.

Now the invention will be described more in particular, in reference with the attached drawing which is given merely as an example, and not for limiting the invention.

Figure 1:
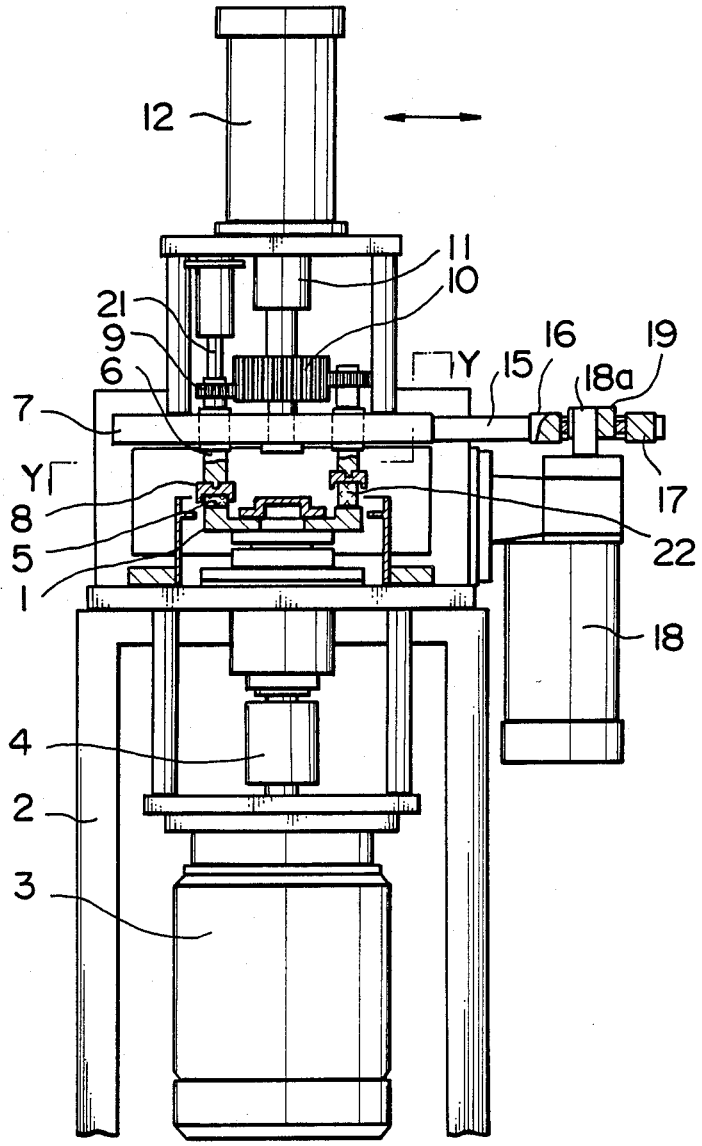
FIG. 1 is an in-part sectional elevational view of a polishing machine realized according to the invention.
Figure 2:
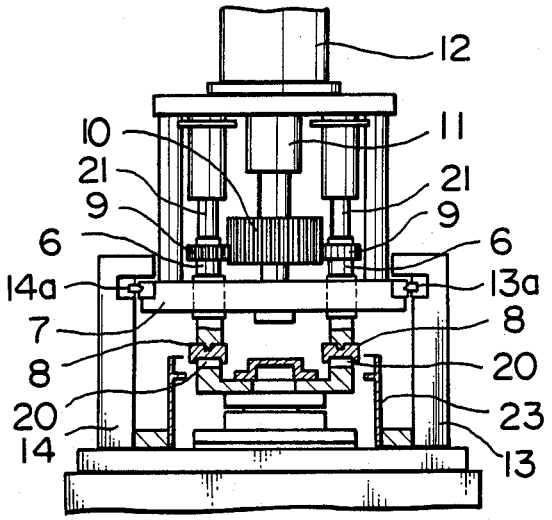
FIG. 2 is a detailed view of the principal portion of such machine.
Figure 3:
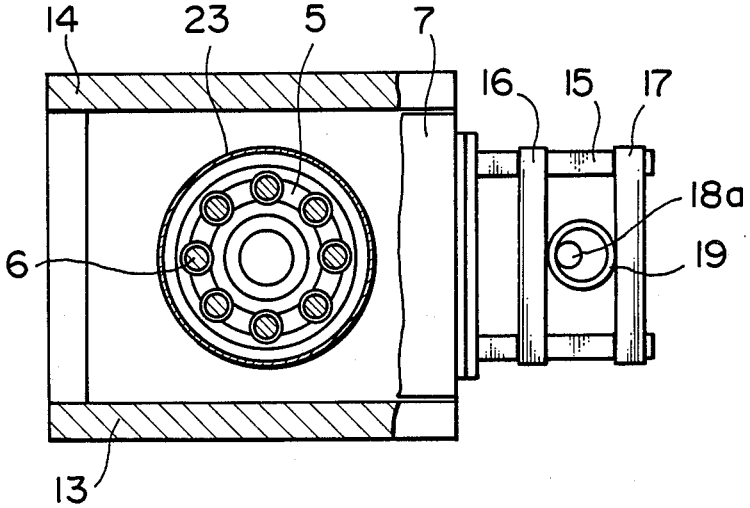
FIG. 3 is a horizontal sectional view as taken along the line Y-Y in FIG. 1.

In the FIGS. the rotary abrasive tool 1 has, on a working face 5, a layer of grains or particles of diamond or cubic or wurtzite type boron nitride of any size, and fixed on a base of steel or other rigid material by electrodeposition, or powder metallurgically, ceramic technique or some other standard techniques in a metallic, vitrified or resinous bonding matrix. The tool is driven by a motor 3 placed in a lower portion of a framework 2 by means of a power train 4. Over the flat or, as desired, somewhat bevel ring working face 5 of the tool 1 there are arranged in a circle several arbors 6, in a position vertical or anyway perpendicular to the working face, which are provided, each, at the lower end with a detachable work holder 8 and driven as a whole by another motor 12 by means of a minor gear 9, a major gear 10, and an appropriate power train 11. As pressed by a pressing rod device 21 which may be actuated either pneumatically, hydraulically or by another standard mechanism in order to keep the work 20 accomodated in the work holder 8 in good contact with the tool working face 5, the arbors 6 together with the minor gears 9 and work holders 8 are slidable to move up and down relative to a stage 7, or horizontal member by means of, for example, standard stroke bearings provided therebetween, and independently from each other. In order to faciliate the rotation of the arbor while the pressing rod does not rotate, a suitable bearing, such as, for example, thrust bearing, is provided and inserted between the rod and the arbor and, conveniently, may be fitted to the top of each arbor. The horizontal member 7 holding the arbors may either consist of simply a middle stage fixed to the framework 2 or, in case where in particular the flat working face is employed, as a carriage slidable in parallel with and over the rotary tool, on- and guided by a pair of rails 13a and 14a on side boards 13 and 14, respectively. The movable carriage 7 is actuated by a further motor 18 through a power transmission mechanism such that a ring 19 fitted eccentrically on the output shaft 18a of the motor 18 rotates in sliding contact with a pair of cross bars 16 and 17, so as the ring rotates the cross bars, and therefore lateral bars 15 fixed thereto and finally the carriage with those arbors and work holders, are pushed towards or pulled away from the rotary tool, cyclically. This feature allows, in particular, machining or works relatively large to the width of the effective face of the tool 1, and has been found very effective in increasing the service life of the tool by using more effectively the entire width of the working face and, thus, minmizing the uneven consumption of the abrasive grains thereon, than when the works 20 simply rotate at fixed positions on the area. The stroke of the carriage 7 may be regulatable simply by changing the ring 19 O.D. and the spacing between the cross bars 16, 17. When works as large or smaller than such width the machine may be operated with the carriage 7 held at the position such that the circle of the work holders resting at a position coaxial with the tool thereunder. Or, more simply, the machine may be of a construction with the stationary middle stage as mentioned above. The work holders are variable in number dependently on the size of the work and, thus, work holders, although four or more arbors are desirable. Instead of using all the holders for normally containing a work, it is also practiceable that a block of abrasive 22, such as green carborundum, be fitted one of the holders in order to dress the rotary tool while in operation. For this purpose, the pressing may not be necessary. It is also preferable, not always essential though, that a cylindrical water shield 23 be provided around the tool in order that coolant water, when used and injected on the tool surface, does not sprinkle around to working circumstance. The machine described above can achieve any degree of surface finish quality as desired simply by changing the grain size of the super abrasive used on the tool working face.

EXAMPLE 1

The tool had a working face electrodeposited with IMG grade (Tomei Diamond Co., Ltd. Japan, product for metal bonding application) of 230/270 mesh/in size at a concentration of 100 on a stainless steel based of 20 cm and 15 cm in OD. and I.D., respectively. Eight cup-shaped holders, in all, of an 8 cm I.D. each, were loaded of three discs, each, 13.8 mm across of sintered polycrystalline diamond, fixed with adhesive, while the arbors were lowered and the work holders were coupled with them. The tool was rotated at 3000 r.p.m. while the work holders at 60 r.p.m. thrusted at the top by small hydraulic rams, with the carriage unactuated.

The work of superhard material was primarily polished at 20 microns/hour in two hours, in comparison with six hours and a half taken for a polishing of a corresponding work surface with a conventionally designed machine which could hold no more than eight pieces of the work per run.

EXAMPLE 2

The operation of Example 1 was repeated except that the tool was electrodeposited with 325/400 mesh/in diamond grains, while each of the work holders was loaded by fitting with adhesive of several sector pieces of the super hard material, which had been cut out from a primarily polished disc. While actuating the pressing device to press downwards the arbors, and driving the carriage to a stroke of 8 mm. and 30 cycles/min. in wet mode, the works were mirror finished with a thickness reduction of 10 microns in an hour.

We claim:

1. A polishing machine comprising: a rotary abrasive tool having a flat circuit working face which comprises a mass of super abrasive grains, said face drivable by a motor to rotate about an axis and said tool being supported by a stationary framework, several arbors which, each, have an inversed cup-shaped work holder detachably mounted at a lower end and a minor gear in an upper portion thereof, said work holders being arranged in such relation that the open end of each of said work holders is opposite, at least partly, to said tool working face, said minor gears being engaged slidably in a vertical direction along- and with a major gear which in turn is driven by a second motor, each said arbor being engaged with a pressing device capable of pressing the work in order to keep in good contact with the working face, a mobile upper portion, on which said arbors, pressing devices, and the second motor are supported and which is engaged in a slidable and guided relation with the framework, and a device to cause a cyclic motion of said mobile upper portion in parallel with the working face.

* * * * *